US005984748A

United States Patent [19]

Ritter et al.

[11] Patent Number: 5,984,748

[45] Date of Patent: Nov. 16, 1999

[54] METHOD FOR FABRICATING A FLAT PANEL DEVICE

[75] Inventors: Harry W. Ritter, Mesa; Solomon Pena, Chandler; Yumiko Kato, Mesa, all of Ariz.

[73] Assignee: Motorola, Inc., Schaumburg, Ill.

[21] Appl. No.: 09/017,158

[22] Filed: Feb. 2, 1998

[51] Int. Cl.[6] ..... H01J 9/24

[52] U.S. Cl. ..... 445/24

[58] Field of Search ..... 445/24, 25

[56] References Cited

U.S. PATENT DOCUMENTS 5,104,343 4/1992 Muragishi et al. ..... 445/25

FOREIGN PATENT DOCUMENTS 776022 5/1997 European Pat. Off. ..... H01J 9/24

782165 7/1997 European Pat. Off. ..... H01J 9/26

2705163 12/1993 France .

2722187 7/1995 France .

*Primary Examiner*—Kenneth J. Ramsey

*Attorney, Agent, or Firm*—Kate Tobin; Kevin D. Wills

[57] ABSTRACT

A method for fabricating a field emission display (200) includes the steps of affixing a first tab (122) of an alignment member (120) to a protruding portion (118) of an anode plate (113), affixing a second tab (122) of the alignment member (120) to a protruding portion (121) of a cathode plate (112), aligning the anode plate (113) with the cathode plate (112), affixing the anode plate (113) to the cathode plate (112), and, thereafter, removing the alignment member (120) by removing both the protruding portion (118) of the anode plate (113) and the protruding portion (121) of the cathode plate (112). The tabs (122) are connected to a spacer (124). The thermal expansion coefficients of the cathode plate (112), the anode plate (113), and the alignment member (120) are substantially equal to one another.

17 Claims, 1 Drawing Sheet

METHOD FOR FABRICATING A FLAT PANEL DEVICE

FIELD OF THE INVENTION

The present invention relates, in general, to flat panel devices, and, more particularly, to methods for fabricating flat panel devices, such as matrix-addressable field emission devices.

BACKGROUND OF THE INVENTION

Flat panel devices are well known in the art. Flat panel devices provide numerous benefits, such as compactness and low weight. In certain types of flat panel devices, such as matrix-addressable field emission displays and electroluminescent displays, elements on one of two device panels need to be precisely aligned with the elements on the other device panel. For example, a flat panel field emission display has electron emitters on a cathode plate that must be precisely aligned with phosphors on an anode plate. Typically, an array of electron emitters is aligned with an array of phosphor deposits.

To achieve proper alignment between the opposing plates of the final product, the opposing plates of the device are first brought into alignment, such as by optical methods. Then, the initial alignment must be maintained during subsequent fabrication steps. For a field emission display, the initial alignment step is typically followed by handling steps and heat treatments, such as are required to form hermetic seals between the opposing plates. During these processing steps, the alignment must be maintained to within predetermined tolerances. As the resolution of a display is increased, the alignment tolerances require smaller relative displacements of the aligned elements. Thus, high-resolution devices require very precise alignment methods.

It is known in the art to use fixtures to maintain alignment. These fixtures are typically clamped to the opposing plates after the initial alignment step. The clamped fixtures maintain the relative positions of the opposing plates during the subsequent handling and heating steps. However, prior art clamping fixtures are known to cause misalignments outside desired tolerance levels.

It is known to use alignment fixtures made of stainless steel. It is also known in the art to use glass substrates for the opposing plates of a field emission display. Alignment of high-resolution field emission displays has been observed to be poor using prior art stainless steel fixtures. The misalignments are due to the differing expansion rates of the stainless steel and the glass substrates during heat treatments.

During the hermetic sealing process, the opposing plates of the device typically are displaced inwardly toward one another. A disadvantage of the above prior art alignment method is that during this vertical relative displacement, the clamping force exerted by the clamping fixture on the plates can change, causing relative lateral displacement between the plates.

Accordingly, there exists a need for an improved method for fabricating flat panel devices, which provides improved alignment between the opposing plates of the flat panel device.

BRIEF DESCRIPTION OF THE DRAWINGS

Referring to the drawings.

Figure 1:
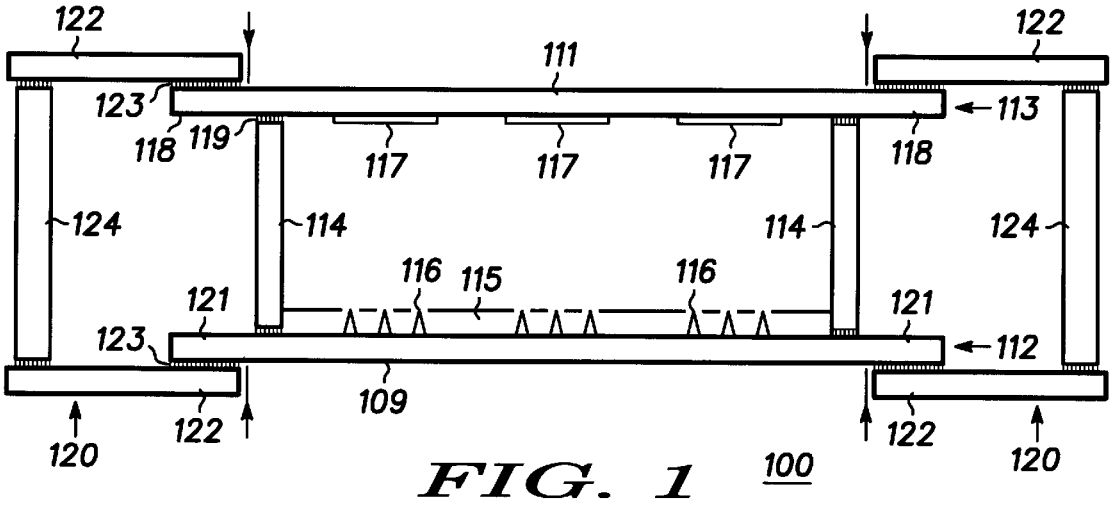
FIG. 1 is a cross-sectional view of an apparatus fabricated in accordance with one embodiment of the invention.

It will be appreciated that for simplicity and clarity of illustration, elements shown in the FIGURES have not necessarily been drawn to scale. For example, the dimensions of some of the elements are exaggerated relative to each other. Further, where considered appropriate, reference numerals have been repeated among the FIGURES to indicate corresponding elements.

DESCRIPTION OF THE PREFERRED EMBODIMENTS

The invention is for a method for fabricating a flat panel device. In general, a flat panel device fabricated in accordance with the invention includes first and second device plates that are precisely aligned with one another. For example, the method of the invention is useful for fabricating matrix-addressable field emission displays, electroluminescent displays, and the like.

The method of the invention includes the steps of affixing an alignment member to first and second device plates of the flat panel device, affixing the first and second device plates to one another, and, thereafter, removing the alignment member from the first and second device plates. In the preferred embodiment, the alignment member includes a first flexible tab, which is affixed to the first device plate, and a second flexible tab, which is affixed to the second device plate. The alignment member of the invention maintains the alignment of the first and second device plates during fabrication steps subsequent to an initial alignment step.

An apparatus realized by affixing the alignment member to the first and second device plates, in accordance with the invention, provides the additional benefits of ease of handling and facilitation of the use of cassettes for handling a plurality of devices simultaneously. For example, many devices can be compactly configured within a cassette. The ability to use a compact cassette facilitates all transporting steps, results in efficient use of space within processing equipment, such as sealing ovens, and generally promotes mass production of the flat panel devices.

FIG. 1 is a cross-sectional view of an apparatus 100 fabricated in accordance with one embodiment of the invention. Apparatus 100 includes an anode plate 113 and a cathode plate 112. Cathode plate 112 includes a plurality of electron emitters 116, which are formed upon a substrate 109 and within wells of a dielectric layer 115. Substrate 109 is made from a dielectric material, such as glass, silicon, and the like. Cathode plate 112 further includes conductive rows and columns (not shown) for selectively addressing electron emitters 116. Methods for fabricating cathode plates for matrix-addressable field emission displays are known to one of ordinary skill in the art.

Anode plate 113 includes a transparent substrate 111 made from, for example, a glass material. Anode plate 113 further includes a plurality of phosphors 117, which are made from a cathodoluminescent material and are disposed upon substrate 111. Methods for fabricating anode plates for matrix-addressable field emission displays are also known to one of ordinary skill in the art.

Apparatus 100 further includes a frame 114 disposed between anode plate 113 and cathode plate 112 and which is useful for maintaining a separation distance between cathode plate 112 and anode plate 113. In the embodiment of FIG. 1, frame 114 is a rectangular structure that encloses the active areas of cathode plate 112 and anode plate 113. Frame 114 has a thermal expansion coefficient that is substantially equal to the thermal expansion coefficients of cathode plate 112 and anode plate 113. In the preferred embodiment, frame 114 is made from glass.

In accordance with the preferred embodiment of the invention, cathode plate 112 includes a protruding portion 121, which extends beyond the position of frame 114, and anode plate 113 includes a protruding portion 118, which extends beyond the position of frame 114. Protruding portions 121 and 118 are portions of substrates 109 and 111, respectively, which extend beyond the active regions. The active region of cathode plate 112 is the area covered by electron emitters 116; the active region of anode plate 113 is the area covered by phosphors 117.

In the embodiment of FIG. 1, one alignment member 120 is affixed at each of the opposing sides of anode plate 113 and cathode plate 112. However, the scope of the invention is not limited to the particular number and configuration of alignment members 120 shown in the drawings. Several alignment members can be positioned about the plates of the device, the number of alignment members 120 being selected to maintain the initial alignment of the plates. The number of alignment members will depend, for example, on the length of each of alignment members 120 and upon the size of the flat panel device.

In the preferred embodiment, each of alignment members 120 includes a pair of opposing tabs 122, each of which is affixed at one end to one of the device plates and at the opposing end to a spacer 124. Spacer 124 maintains the separation between tabs 122. However, the scope of the invention is not limited to the particular structure of alignment members 120 that is shown in the drawings. For example, each of alignment members 120 can include one continuous structure, to which has been imparted the appropriate shape by, for example, molding of a moldable material.

Alignment members 120 have a thermal expansion coefficient that is substantially equal to the thermal expansion coefficients of cathode plate 112 and anode plate 113. In other words anode plate 113, cathode plate 112, and alignment members 120 expand at similar rates during heat treatments of apparatus 100. In this manner none of the elements mechanically fail (break), and the appropriate alignment of cathode plate 112 and anode plate 113 is maintained. In the preferred embodiment, substrates 109 and 111 are made from soda lime glass, and alignment members 120 are made from a material having a thermal expansion coefficient substantially equal to that of soda lime glass, such as titanium, a nickel/iron alloy, and the like.

A method for fabricating a flat panel device in accordance with the invention includes the step of affixing alignment members 120 to anode plate 113 and cathode plate 112. In the preferred embodiment, apparatus 100 is made by first fabricating cathode plate 112 and anode plate 113. Then, alignment members 120 are affixed to anode plate 113 and cathode plate 112. The step of affixing alignment members 120 generally includes permanently bonding, gluing, and the like. Subsequent to their formation, the bonds between alignment members 120 and anode plate 113 and cathode plate 112 remain sufficiently permanent and immovable to maintain alignment between anode plate 113 and cathode plate 112 during fabrication steps.

In the preferred embodiment, the step of affixing alignment members 120 includes the step of affixing tabs 122 to substrates 109 and 111, respectively, prior to an initial alignment step. An affixant 123 is placed between tabs 122 and protruding portions 118 and 121. Affixant 123 is a convenient bonding agent, such as a devitrifying solder glass, a glue, and the like. Affixant 123 is useful for creating a permanent bond between tabs 122 and cathode plate 112 and anode plate 113 at protruding portions 121 and 118, respectively. Affixant 123 has the characteristic that it maintains the immovable bond during subsequent fabrication steps, such as subsequent heating steps.

A first opposing end of spacer 124 is spot welded to each of tabs 122, which are attached to cathode plate 112. A layer of a sealant 119 is positioned upon cathode plate 112. Sealant 119 is useful for affixing frame 114 to cathode plate 112. In the embodiment of FIG. 1, the layer of sealant 119 includes a solid piece of uncured glass frit. Frame 114 is placed upon the layer of sealant 119. A second layer of sealant 119 is placed on frame 114 and is useful for affixing frame 114 to anode plate 113.

Then, anode plate 113 is aligned with cathode plate 112. The alignment of anode plate 113 and cathode plate 112 includes the use of convenient alignment methods known to one of ordinary skill in the art. Such methods include optical alignment methods, mechanical alignment methods, and the like. The initial alignment step results in the appropriate relative positioning of plurality of electron emitters 116 with respect to plurality of phosphors 117. Then, anode plate 113 is placed upon the second layer of sealant 119. After the initial alignment step, a second opposing end of spacer 124 is spot welded to each of tabs 122, which are attached to anode plate 113.

Subsequent to the step of affixing alignment members 120 and in accordance with the invention, anode plate 113 is affixed to cathode plate 112. The step of affixing anode plate 113 to cathode plate 112 includes first placing apparatus 100 in an evacuation chamber. After apparatus 100 is placed in the evacuation chamber, the evacuation chamber is evacuated down to a pressure of less than about $1.33\times10^{-4}$ Pascal ($10^{-6}$ torr). During the evacuation step, gases are able to flow out of the region between cathode plate 112 and anode plate 113 through gaps that exist between the solid layer of sealant 119 and anode plate 113, as well as the gaps between solid layer of sealant 119 and frame 114. Gases are similarly capable of escaping through gaps that exist between solid layer of sealant 119 and cathode plate 112.

The gases are capable of being pumped out of alignment members 120 because alignment members 120 do not completely enclose or circumscribe the device. During the evacuation step, alignment members 120 maintain a separation between cathode plate 112 and anode plate 113 for achieving the vacuum within the device. In this manner, the pressure within the device is reduced to less than about $1.33\times10^{-4}$ Pascal ($10^{-6}$ torr).

Subsequent to the evacuation step, anode plate 113 is affixed to cathode plate 112. In the embodiment of FIG. 1, this step includes the step of heating apparatus 100 to a temperature suitable for curing sealant 119 to create a hermetic seal between frame 114 and each of cathode plate 112 and anode plate 113. An exemplary temperature for this curing step for sealant 119, which is a glass frit, is about 425 degrees Celsius (° C.). During the heating step for affixing anode plate 113 to cathode plate 112, affixant 123 maintains the permanent bonds between alignment members 120 and cathode plate 112 and anode plate 113 to retain the initial alignment.

Concurrent with the heating step, pressure is applied to cathode plate 112 and anode plate 113 to promote the bonding to frame 114. Alignment members 120 have flexibility in a direction perpendicular to a plane defined by anode plate 113. This flexibility is sufficient to allow the displacement of alignment members 120 to an extent that permits cathode plate 112 and anode plate 113 to be pushed toward one another during the step of applying pressure to the plates.

On the other hand, alignment members 120 have stiffness in a direction parallel to a plane defined by anode plate 113. This stiffness is sufficient to prevent displacement of alignment members 120 to an extent that maintains alignment between cathode plate 112 and anode plate 113 within a desired tolerance. These mechanical properties of alignment members 120 are achieved, in part, by selecting a suitable geometry, such as the dimensions of tabs 122, and depend upon, for example, the mechanical properties of the material selected for alignment members 120.

Affixant 123 is selected to provide sufficiently immovable bonds between alignment members 120 and the plates of the device throughout the sealing step described above. If applicable, a bonding agent between tabs 122 and spacers 124 is similarly selected to maintain permanent bonding during the sealing step.

Subsequent to the heating step, apparatus 100 is allowed to cool to room temperature. After the structure has cooled, alignment members 120 are removed by removing protruding portions 118 and 121 from substrates 111 and 109, respectively. The removal of protruding portions 118 and 121 can be accomplished by a convenient glass severing method, such as trimming with a diamond saw, scribing followed by breaking, and the like. The severing step is performed at locations along substrates 109 and 111 as indicated generally by vertical arrows in FIG. 1.

Figure 2:
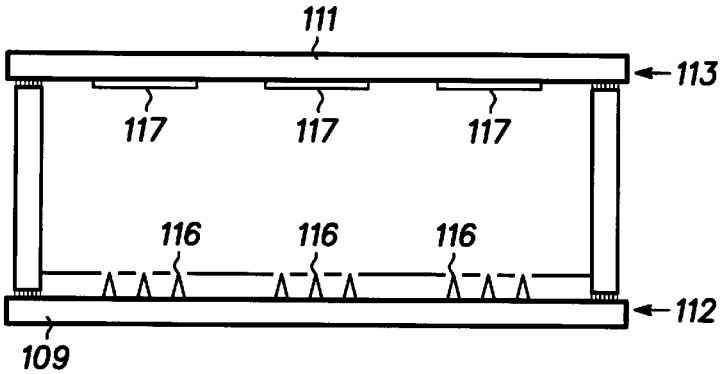
FIG. 2 is a cross-sectional view of a field emission display fabricated in accordance with the invention.

FIG. 2 is a cross-sectional view of a field emission display 200 fabricated in accordance with the method of the invention. In FIG. 2 alignment members 120 (FIG. 1) have been removed. The space between cathode plate 112 and anode plate 113 is evacuated, and the hermetic seals formed during the sealing step described with reference to FIG. 1 maintain the internal vacuum. While the method of the invention has been described with reference to the fabrication of a field emission display, the method of the invention can be embodied in the fabrication of other flat panel devices, such as electroluminescent displays and the like.

Figure 3:
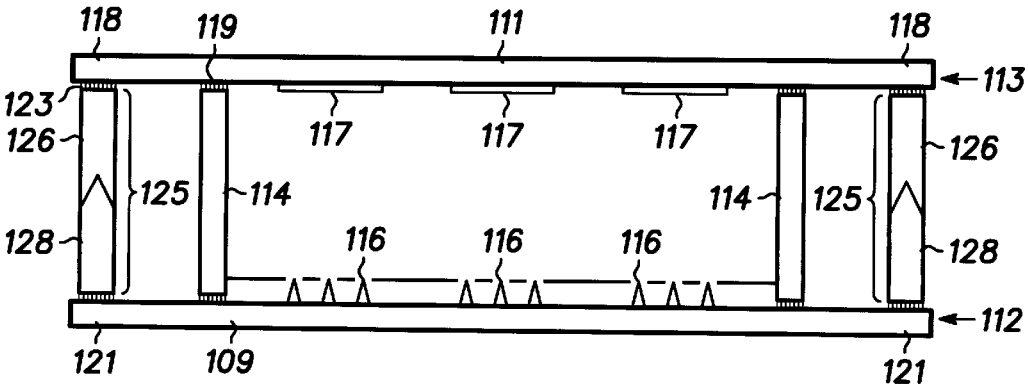
FIG. 3 is a cross-sectional view of an apparatus fabricated in accordance with another embodiment of the invention.

FIG. 3 is a cross-sectional view of an apparatus 300 fabricated in accordance with another embodiment of the invention. In FIG. 3 cathode plate 112 and anode plate 113 are maintained in proper alignment during fabrication by a plurality of alignment members 125.

Each of alignment members 125 includes a first mating member 126 and a second mating member 128. First mating member 126 is affixed at one end to substrate 111 at protruding portion 118. Second mating member 128 is similarly affixed at one end to substrate 109 at protruding portion 121. First and second mating members 126 and 128 are affixed using affixant 123, which is selected to provide a permanent bond during the evacuation and sealing steps and is useful for maintaining the alignment between cathode plate 112 and anode plate 113.

The remaining ends of first and second mating members 126 and 128 are designed to be mated together. In the embodiment of FIG. 3, first and second mating members 126 and 128 are generally cylindrically-shaped structures. However, the scope of the invention is not limited to the particular geometry illustrated in the drawings.

The steps for fabricating apparatus 300 are similar to those described with reference to FIG. 1. Additionally, first and second mating members 126 and 128 are positioned so that they can be mated together during the step of aligning anode plate 113 with cathode plate 112. Prior to the step of affixing anode plate 113 to cathode plate 112, first mating member 126 is mated with second mating member 128.

It will be understood by one of ordinary skill in the art that the sequence of steps in the methods described herein may be altered as appropriate.

In summary, the invention is for a method for fabricating a flat panel device. The method of the invention includes the step of affixing an alignment member to the opposing plates of the device for maintaining alignment between the opposing plates during the step of affixing the opposing plates to one another. The method of the invention provides a method for fabricating high-resolution flat panel devices, such as high-resolution field emission displays.

What is claimed is:

1. A method for fabricating a flat panel device comprising the steps of:

providing a first device plate having a first thermal expansion coefficient;

providing a second device plate having a second thermal expansion coefficient;

aligning the first device plate with the second device plate;

affixing an alignment member to the first device plate and to the second device plate, wherein the alignment member has a third thermal expansion coefficient, and wherein the first, second and third thermal expansion coefficients are substantially equal to one another;

affixing the first device plate to the second device plate; and thereafter, removing the alignment member from the first device plate and from the second device plate.

2. The method for fabricating a flat panel device as claimed in claim 1, wherein the alignment member comprises a first tab and a second tab, and wherein the step of affixing the alignment member to the first device plate and to the second device plate comprises the steps of affixing the first tab to the first device plate and affixing the second tab to the second device plate.

3. The method for fabricating a flat panel device as claimed in claim 1, wherein the first device plate comprises a protruding portion and the second device plate comprises a protruding portion, and wherein the step of affixing an alignment member to the first device plate and to the second device plate comprises the step of affixing an alignment member to the protruding portion of the first device plate and to the protruding portion of the second device plate, and wherein the step of removing the alignment member comprises the steps of removing the protruding portion of the first device plate and removing the protruding portion of the second device plate.

4. The method for fabricating a flat panel device as claimed in claim 3, wherein the step of removing the protruding portion of the first device plate comprises the step of severing from the first device plate the protruding portion of the first device plate, and wherein the step of removing the protruding portion of the second device plate comprises the step of severing from the second device plate the protruding portion of the second device plate.

5. The method for fabricating a flat panel device as claimed in claim 1, wherein the alignment member comprises a first mating member and a second mating member, and wherein the step of affixing the alignment member to the first device plate and to the second device plate comprises the steps of affixing the first mating member to the first device plate and affixing the second mating member to the second device plate, and further including the step of, prior to the step of affixing the first device plate to the second device plate, mating the first mating member with the second mating member.

6. The method for fabricating a flat panel device as claimed in claim 1, wherein the alignment member is characterized by flexibility in a direction perpendicular to a plane defined by the first device plate, and wherein the flexibility of the alignment member is sufficient to allow displacement of the alignment member to an extent that allows the second device plate and the first device plate to be displaced toward one another during the step of affixing the first device plate to the second device plate.

7. The method for fabricating a flat panel device as claimed in claim 1, wherein the alignment member is characterized by stiffness in a direction parallel to a plane defined by the first device plate, and wherein the stiffness of the alignment member is sufficient to prevent displacement of the alignment member to an extent that maintains alignment between the second device plate and the first device plate.

8. A method for fabricating a field emission display comprising the steps of:

providing an anode plate having a first thermal expansion coefficient;

providing a cathode plate having a second thermal expansion coefficient;

aligning the anode plate to the cathode plate;

affixing an alignment member to the anode plate and to the cathode plate, wherein the alignment member has a third thermal expansion coefficient, and wherein the first, second and third thermal expansion coefficients are substantially equal to one another;

affixing the anode plate to the cathode plate; and thereafter, removing the alignment member from the anode plate and from the cathode plate.

9. The method for fabricating a field emission display as claimed in claim 8, wherein the alignment member comprises a first tab and a second tab, and wherein the step of affixing the alignment member to the anode plate and to the cathode plate comprises the steps of affixing the first, tab to the anode plate and affixing the second tab to the cathode plate.

10. The method for fabricating a field emission display as claimed in claim 8, wherein the anode plate comprises a protruding portion and the cathode plate comprises a protruding portion, and wherein the step of affixing an alignment member to the anode plate and to the cathode plate comprises the step of affixing an alignment member to the protruding portion of the anode plate and to the protruding portion of the cathode plate, and wherein the step of removing the alignment member comprises the steps of removing the protruding portion of the anode plate and removing the protruding portion of the cathode plate.

11. The method for fabricating a field emission display as claimed in claim 10, wherein the step of removing the protruding portion of the anode plate comprises the step of severing from the anode plate the protruding portion of the anode plate, and wherein the step of removing the protruding portion of the cathode plate comprises the step of severing from the cathode plate the protruding portion of the cathode plate.

12. The method for fabricating a field emission display as claimed in claim 8, wherein the alignment member comprises a first mating member and a second mating member, and wherein the step of affixing the alignment member to the anode plate and to the cathode plate comprises the steps of affixing the first mating member to the anode plate and affixing the second mating member to the cathode plate, and further including the step of, prior to the step of affixing the anode plate to the cathode plate, mating the first mating member with the second mating member.

13. The method for fabricating a field emission display as claimed in claim 8, wherein the cathode plate comprises a glass substrate and the anode plate comprises a glass substrate, and wherein the alignment member comprises titanium.

14. The method for fabricating a field emission display as claimed in claim 8, wherein the alignment member is characterized by flexibility in a direction perpendicular to a plane defined by the anode plate, and wherein the flexibility of the alignment member is sufficient to allow displacement of the alignment member to an extent that allows the cathode plate and the anode plate to be displaced toward one another during the step of affixing the anode plate to the cathode plate.

15. The method for fabricating a field emission display as claimed in claim 8, wherein the alignment member is characterized by stiffness in a direction parallel to a plane defined by the anode plate, and wherein the stiffness of the alignment member is sufficient to prevent displacement of the alignment member to an extent that maintains alignment between the cathode plate and the anode plate.

16. The method for fabricating a field emission display as claimed in claim 8, wherein the step of affixing an alignment member to the anode plate and to the cathode plate comprises the step of affixing an alignment member to the anode plate and to the cathode plate with an affixant.

17. The method for fabricating a field emission display as claimed in claim 16, wherein the affixant comprises a devitrifying solder glass.

* * * * *